United States Patent [19]

Markus

[11] 3,961,775

[45] June 8, 1976

[54] METHOD AND APPARATUS FOR LIQUID MIXING

[75] Inventor: Frank Markus, Burlington, Canada

[73] Assignee: The Steel Company of Canada, Limited, Hamilton, Canada

[22] Filed: Nov. 25, 1974

[21] Appl. No.: 527,026

[30] Foreign Application Priority Data

Nov. 28, 1973 United Kingdom ..... 55297/73

[52] U.S. Cl. ..... 259/24; 259/96

[51] Int. Cl.[2] ..... B01F 7/26

[58] Field of Search ..... 259/7, 8, 22, 23, 24, 259/43, 44, 66, 67, 96, 95, 107, 108, 121, 122

[56] References Cited

UNITED STATES PATENTS

| | | | |
|---|---|---|---|
| 780,260 | 1/1905 | Beemer | 259/96 |
| 897,481 | 9/1908 | Pease | 259/24 |
| 2,588,591 | 3/1952 | Thompson | 259/23 |
| 3,128,084 | 4/1964 | Castor | 259/96 |
| 3,414,245 | 12/1968 | Frazer | 259/96 |

*Primary Examiner*—Robert W. Jenkins
*Attorney, Agent, or Firm*—Sim & McBurney

[57] ABSTRACT

This invention provides a method and apparatus for increasing interface contact between two immiscible liquids. A rotor with internal pumping passages is immersed beneath the interface and rotated to draw the interface down to the rotor, whereby the upper, less dense liquid is pumped into the lower, more dense liquid.

6 Claims, 22 Drawing Figures

METHOD AND APPARATUS FOR LIQUID MIXING

Figure 1:
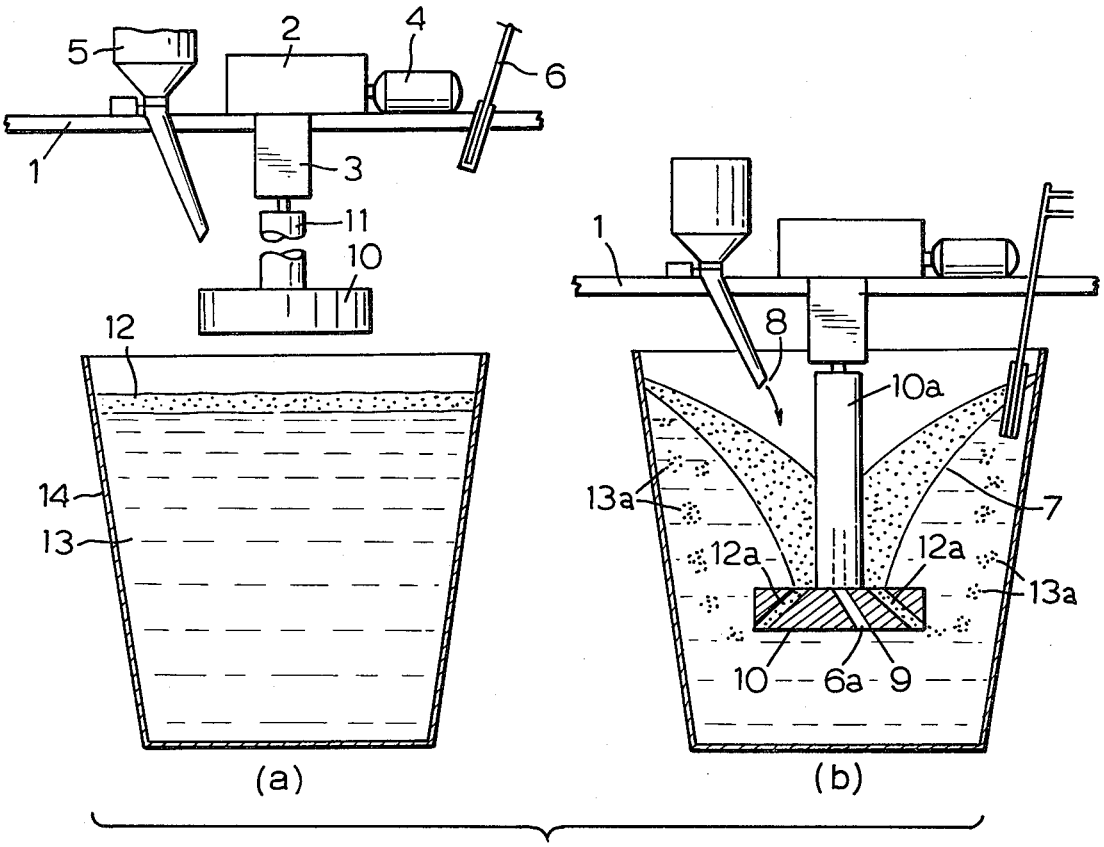

This invention relates generally to liquid mixing, and more particularly to any process where it is desired to increase the surface of contact between two immiscible liquids of different densities in the same container. Still more particularly, this invention pertains to the art of manufacturing metal, where this requires the molten metal to come into contact with slag materials for certain chemical reasons.

Considered from another aspect, this invention in one preferred application is concerned with producing steel with a low sulphur and oxygen content.

BACKGROUND OF THIS INVENTION

Although this invention relates generally to the art of mixing liquids and is applicable to areas outside the particular art of steel manufacture, it has a special application in the metallurgical techniques, and for this reason the present section deals with the background relating to steel metallurgy.

In the art of steel metallurgy, a great deal of attention is paid to the desirability and the degree of reduction of the content of two particular elements in the steel, namely sulphur and oxygen. These two elements have a tendency to combine with iron or alloying elements present in the steel to form nonmetallic inclusions.

Inclusions have significant influences on various properties of the finished product. Although almost all product properties are influenced in some way by these nonmetallic inclusions, the most harmful effects are found in relation to steel impact resistance and shelf energy. It has been proven that the reduction of sulphur to a low content (0.003 to 0.010 percent) in combination with a low oxygen content (0.002 to 0.005 percent) will produce a steel with a limited number of nonmetallic inclusions. The remaining inclusions, especially if their chemistry is controlled by the addition of certain elements such as rare earth elements, will have harmless effects on steel properties.

In the steelmaking plant the refining of steel is performed within steelmaking furnaces (open hearth, basic oxygen, electric arc, or induction furnaces). The time required for refining restricts the furnace productivity, since the furnace cannot be used for melting and other necessary operations during the refining time. This invention, by using the ladle as a primary vessel for steel refining, is directed to increasing the productivity and decreasing the operating costs of a steelmaking shop. A steelmaking ladle is generally idle during normal shop operation, but is a much cheaper vessel than the furnace.

This invention could also prove advantageous in a steelmaking shop which uses high sulphur pig iron. The steel tapped from the steelmaking furnace could have a high sulphur content which can subsequently be reduced considerably by the process of this invention as it applies to steelmaking. High sulphur pig iron can be produced in the blast furnace more efficiently than low sulphur pig iron, since the reduction of stone addition will result in an increase in blast furnace productivity, a decrease in specific energy input per ton of metal and a lower slag volume. These benefits are expected to produce savings far greater than the cost of operating the refining installation in the steelmaking shop.

This invention also is directed to increasing the yield of alloying elements, particularly those with high affinity to oxygen. Additives such as rare earth silicides or other alloys are added to a highly deoxidized metal and slag system in accordance with this invention, and loss of the additives to oxygen is significantly reduced. A reduction of the amount of alloying elements is thus permitted, which brings about material savings which can be much higher than the cost of operating the process herein disclosed.

The process of this invention, in its particular application to steel matallurgy, is based on the fact that the composition of the slag exerts a significant and important influence on the metallurgical reactions between the steel and the slag. The extent of such reactions is a function of the physico-chemical laws and the mathematical laws of the kinematics of reaction and is accordingly limited. Nevertheless, the deoxidation and desulphurization of steel by slag which is treated according to a preferred form of the process of this invention has been found to be very efficient. In this preferred form, the process of this invention includes the controlling of the slag composition, so as to control in turn the interaction between the slag and the steel.

The process of this invention, in accordance with its preferred form particularly applicable to steel metallurgy, involves influencing the chemical reactions in the molten steel by bringing about an increase of the interface area between the steel and the slag on the one hand, and by influencing the physical inclusions between the slag and the already formed nonmetallic inclusions on the other hand. In addition to the foregoing, the properties of the slag may be controlled by additives placed on the slag surface, either continuously during the process itself, or prior to the beginning of the process.

It has been known for some time that the desulphurization capability of steelmaking slags is related to the slag oxidizing potential (FeO, MnO, $Cr_2O_3$, $P_2O_5$ content) and to its basicity (CaO, MgO, $SiO_2$, $Al_2O_3$ content). The slag oxidizing potential can be reduced by the addition of additives with a high affinity for oxygen. For example, silicon will react with FeO and MnO forming $SiO_2$, which is very stable and readily soluble in the slag. Metallic silicon is very expensive, but its alloys are highly suitable and economical. Ferro-silicon and calcium are two of the many such alloys. Various other materials such as lime, silica, magnesia, alumina, spar, and others can be mixed in various ratios to create a beneficial slag treatment mixture. Any slag treatment mixture should be based on some knowledge of the slag chemistry before slag treatment, and on a good estimation of the optimum slag composition after the treatment.

The oxygen level of the metallic bath is a function of the slag oxidizing potential. A low oxygen content in the bath can be contained by bringing about a low oxygen content in the slag, and also a sufficiently high interface area between the slag and the steel. The process of this invention in its preferred form particularly suited to steel metallurgy contemplates bringing about both of these conditions.

Recent developments in physical metallurgy, together with certain economic aspects of modern designing techniques, have resulted in tighter specifications for steel quality. One of the more important factors in steel quality is identified as steel cleanliness. Various processes for obtaining improved steeel cleanliness have been patented, and some of them are used on a production scale. These processes may be divided generally into four main groups:

1. Steel treatment by an artificial molten or unmolten slag placed on the ladle bottom prior to tapping of the furnace.
2. Vacuum degassing and alloying under vacuum.
3. Injection of desulphurizing additives or mixtures of artificial slag components with desulphurizing additivies under the steel surface.
4. Increase of the steel slag interface using
   a. Induction mixing
   b. Mechanical stirring.

Although some of the processes belonging to these groups have proven themselves in production conditions, they are attended by certain disadvangages, among which are the following:

1. High capital investment and/or high operating costs.
2. Air pollution problems.
3. Small effect on steel cleanliness.

GENERAL DESCRIPTION OF THIS INVENTION

In view of the foregoing background, and in accordance with one of its particular aspects, this invention pertains to a metallurgical refining process intended primarily to obtain improved steel cleanliness. However, it will be obvious from what follows that the basic principles involved in the method and apparatus of this invention can be applied to fields other than that of steel metallurgy.

This specification discloses, in combination: a container for liquids, and a rotor of substantially circular outline having generally an upper face and a lower face, and having a diameter small enough to fit within said container, the rotor having at least one internal passageway which opens at one end through said upper face at a first location adjacent the rotor axis, the other end of the passageway opening at a second location of the rotor which is further from the rotor axis than said first location, and means for rotating said rotor about the rotor axis while the axis is substantially vertical.

This specification also discloses a rotor for use with a container for liquids, the rotor being of substantially circular outline and having generally an upper face and a lower face, at least one internal passageway in the rotor which opens at one end through said upper face at a first location adjacent the rotor axis, the other end of the passageway opening at a second location on the rotor, the second location being further from the rotor axis than is said first location.

Furthermore, this invention provides a method of increasing the surface contact between two immiscible fluids of different specific densities, comprising the steps: placing the two liquids in a container to form an interface with the less dense liquid above the interface and the more dense liquid below the interface, providing a rotor of substantially circular outline having generally an upper face and a lower face, the rotor having at least one internal passageway which opens at one end through the upper face at a first location adjacent the rotor axis, the other end of the passageway opening at a second location on the rotor, the second location being further from the rotor axis than is said first location, inserting said rotor into said container sufficiently far to bring said upper face beneath said interface when the liquids are at rest, the axis of the rotor being generally vertical, and rotating the rotor about its axis at a speed sufficient to draw a part of the interface down to the upper face of the rotor, whereby the less dense liquid passes into said one end of said passageway and is pumped through said passageway into said more dense liquid.

In the process of this invention as it pertains particularly to the art of steel metallurgy, the less dense material corresponds to the molten or partially molten slag, while the more dense material corresponds to the molten metal. The slag is mechanically pumped deeply under the steel surface by the rotor of this invention. Optionally, the performance of the rotor of this invention may be combined with a continuous feeding of a beneficial slag mixture on top of the slag layer. As another alternative, the process may involve alloying, using a certain kind of oxidizable additive. Such alloying may be performed either on top of the slag mixture or under it. When materials are to be added, for example the slag forming mixture or metallic additives used for slag treatment, these may be fed by a gravitational system on top of the slag close to the rotating shaft of the rotor. The feeding of such materials would normally be carried out at a predetermined rate. Naturally, however, any other kind of continuous or batch feeding system may be used for the same purpose.

One advantage of this invention has to do with increase in the yield of some oxidizable metallic additives, and this may be accomplished by feeding them under the slag layer through a submerged nozzle. Pneumatic lancing could be used for this purpose, and one possible lance arrangement would be to provide a hole in the rotor shaft axis with an overflow at the bottom of the rotor directly into the molten metal. An additional lance could also be provided with its outflow submerged below the slag layer and preferably close to the process vessel wall.

To return to this invention as it pertains to steel making, it will be seen from what follows that the pumping procedure accomplishes a continuous recirculation of a highly liquid and reactive slag. The slag is pumped from a vortex generated by the motion of the rotor in the metallic bath. The rotor draws slag to its upper face around the shaft, and from there specially arranged passages in the rotor body draw the slag downwardly and outwardly and discharge it into the molten metal. On the outflow ends of the pumping passages (where more than one of these is provided), the slag breaks into comparatively small particles which, due to a smaller specific density, rise upwardly through the bath of molten metal. While rising, the particles chemically react with many of the elements, particularly beneficially with sulfur and oxygen. Due to the similarity of the physical properties, the slag on its way upwards also physically interacts with already formed inclusions and continuously carries then to the upper slag layer where they are dissolved. To promote this action, rare earth silicates or other additives are often used since they form highly stable sulphides and oxides.

In one application of this process, during a complete running time of about 5 minutes, the entire slag volume above a bath of molten metal may conceiveably be completely recycled up to several hundred times. It is probable that the optimal number of cycles would lie between 25 and 100. In one preferred application, a steelmaking ladle may be used as the process vessel, although other metallurgical vessels may be used as well.

If at the beginning of the process the slag is an oxidizing slag, then deoxidizing additives may be fed onto its top in order to obtain a reducing slag as soon as possible. When this is carried out with the process of the present invention as it applies particularly to steel metallurgy, a minimization of erosion of the rotor and of the process vessel is attained.

Figure 2:
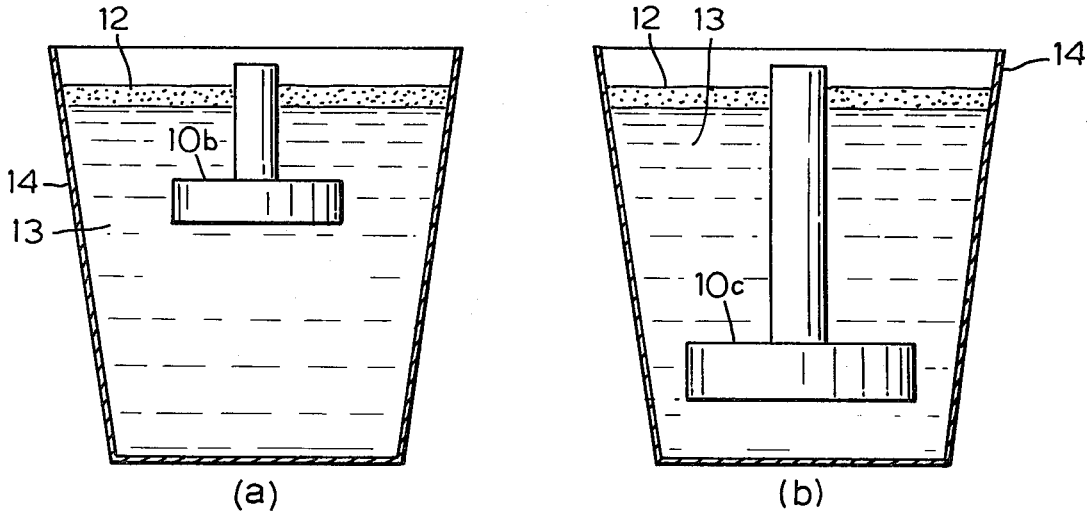
Figure 3:
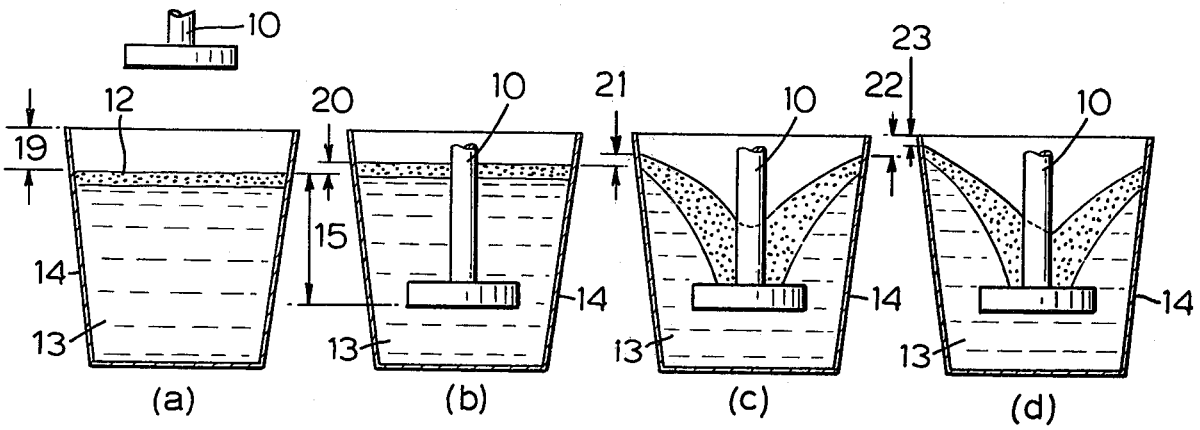
Figure 4:
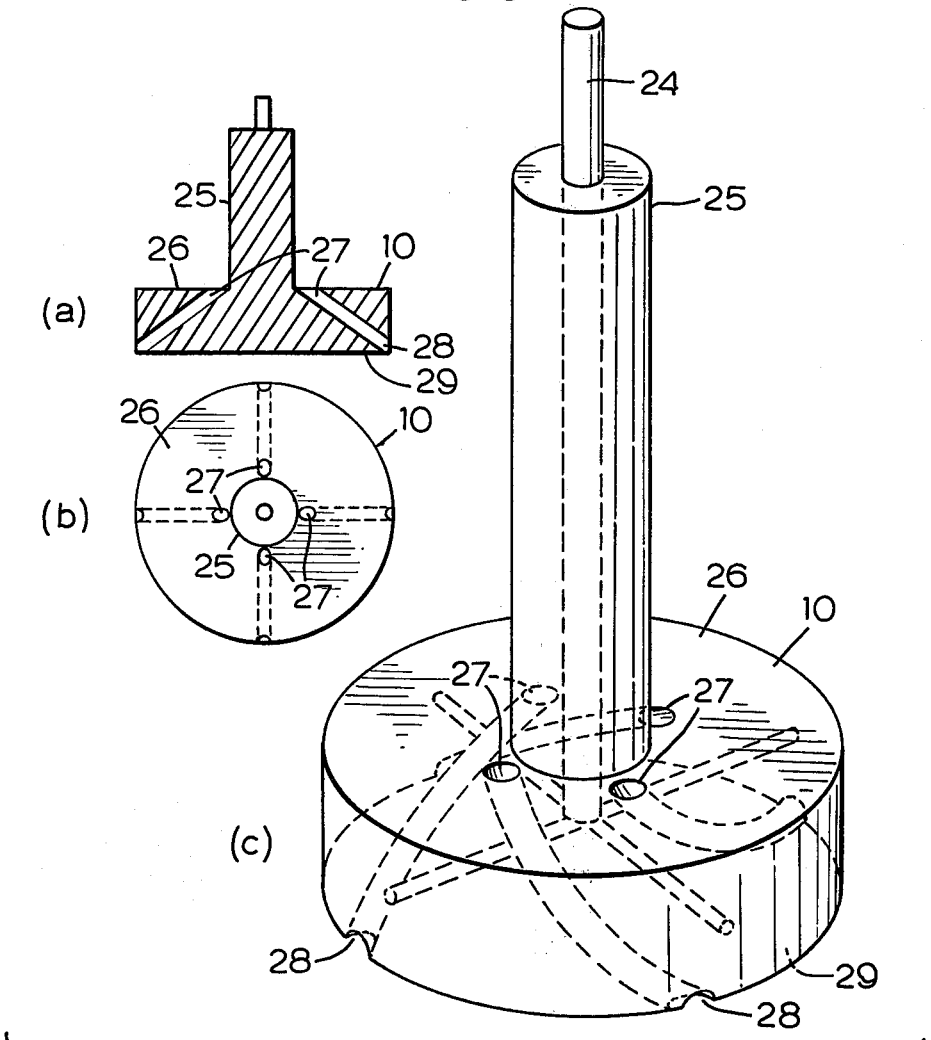
Figure 5:
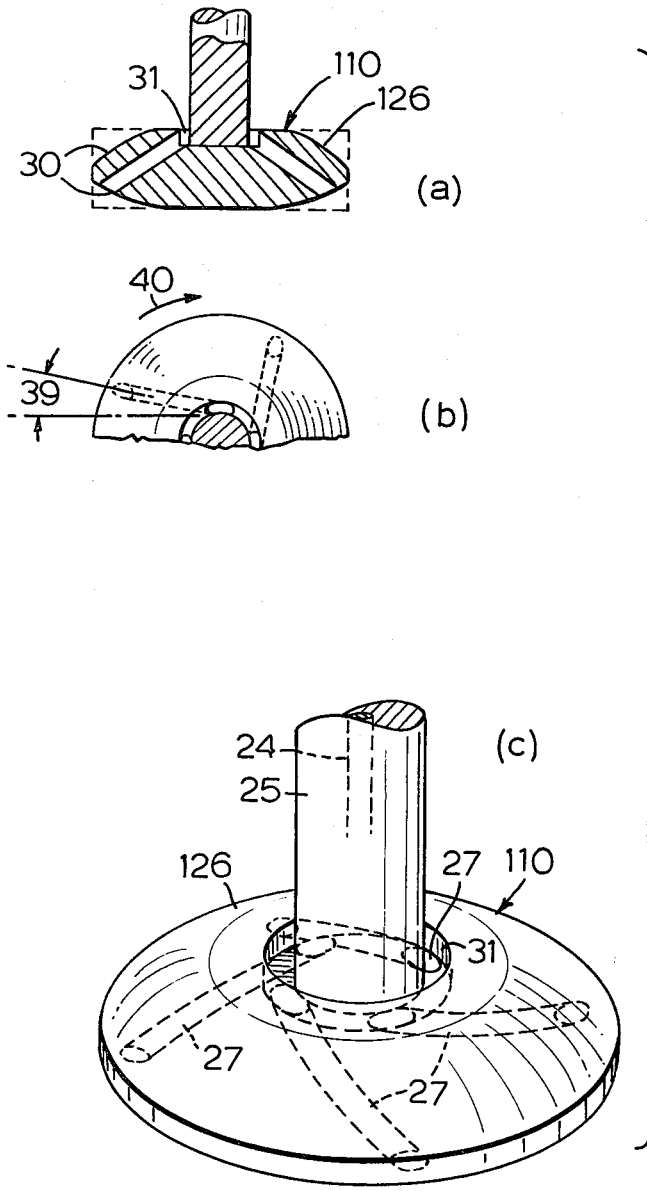
Figure 6:
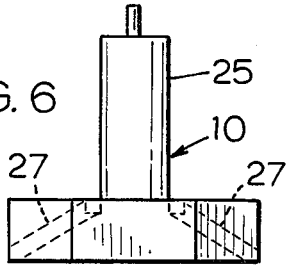
Figure 8:
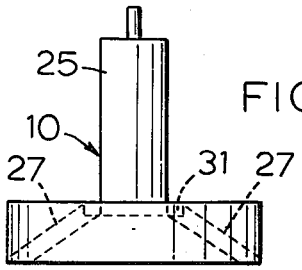
Figure 7:
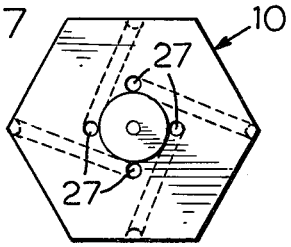
Figure 9:
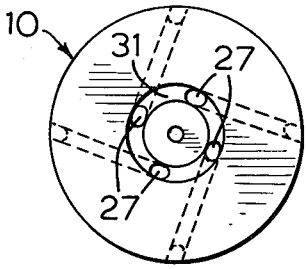

GENERAL DESCRIPTION OF THE DRAWINGS:

Several embodiments of this invention are illustrated in the accompanying drawings, in which like numerals denote like parts throughout the several view, and in which:

FIGS. 1 (*a*) and 1(*b*) are vertical sectional views of apparatus suitable for carrying out the process of this invention, before and during the process, respectively;

FIGS. 2(*a*) and 2(*b*) show two apparatus variations for carrying out the process of this invention;

FIGS. 3(*a*), 3(*b*), 3(*c*) and 3(*d*) are schematic, vertical sectional views of four sequential steps in the process of this invention;

FIGS. 4(*a*), 4(*b*) and 4(*c*) are, respectively a vertical sectional view, and a perspective view of a first embodiment of a rotor suitable for use with the process of this invention;

FIGS. 5(*a*), 5(*b*) and 5(*c*) are, respectively, a vertical sectional view, a partial plan view, and a perspective view of a second embodiment of a rotor suitable for use with the process of this invention; and FIGS. 6 through 13 illustrate four basic variations of a rotor shape suitable for use with the process of this invention, each variation being illustrated in elevation and in plan.

PARTICULAR DESCRIPTION OF THE INVENTION

The following will be a typical sequence of events pertaining to the use of the process and apparatus of this invention with a steel making ladle constituting the vessel.

1. Tap the molten steel and slag from any kind of a steelmaking furnace into a ladle. Some additives may be added now or some may be added later in the process. The laddle must not be filled completely; about five to ten percent of a freeboard space should be left between the slag layer and the top of the ladle.
2. The ladle is transferred to the process stand.
3. An appropriate mixture of artificial slag or flux components should be added, and the rotor should be submerged, while slowly rotating, to a predetermined depth under the slag level. The rotational speed should be increased continuously or step wise to the predetermined level. After a short time of rotation, the whole slag volume will melt.
4. As soon as the whole slag has completely melted, a continuous, semi-continuous or batch feeding of slag treatment mixtures is started, preferably at a predetermined rate. The mixtures may be kept premixed or they may be fed from separate sources to a common feeding system.
5. When the continuous feeding is completed, additives for inclusion shape control and/or steel deoxidation could be added, and some time is allowed to obtain full benefit from these additives. After this rotor is slowed to a reduced speed and lifted upwards from the steel bath. A short time period is allowed to completely separate the slag and the steel phase. This time should approximately equal the time taken to transport the ladle from the process stand to the casting area.

The foregoing steps are the preferred ones when the process of this invention is carried out in connection with steel metallurgy. As pointed out earlier, however, this invention is not restricted to the art of steelmaking, and its broad principles may be applied to any two-liquid system where the liquids are immiscible and of different specific densities For example, a satisfactory mixing of a two-liquid system including carbontetrachlorate and coloured water can be carried out in a small glass container, utilizing a suitably sized rotor constructed in accordance with this invention. Thus, although the following descriptive portion refers specifically to this invention as it pertains, in its preferred form, to the art of steel metallurgy, it should be borne in mind that the invention retains a broad applicability to other two-liquid systems.

Attention is now directed to FIG. 1 of the drawings, which shows a refining installation in accordance with the process of this invention as it particularly pertains to steel metallurgy, the installation being shown in a stationary condition in FIG. 1(*a*), and in an operational condition in FIG. 1(*b*). An equipment supporting structure 1 supports a driving unit which consists of a driving motor 4, a reducing gear box 2 and a rotor supporting box 3. On the equipment supporting structure 1 any other equipment necessary for the process may be located. This may include a gravity feeder 5 and a pneumatic lance 6 for subsurface alloy additions. A connector 11 supports a rotor 10, the connector 11 being connected to the supporting box 3. A ladle 14 contains molten steel 13 and an overlying layer of fully or partly molten slag 12. The axis of the rotor 10 and the axis of the ladle 14 should coincide as closely as possible. The steel treatment alloys may be introduced to the molten steel 13 by way of the pneumatic lance 6 which penetrates just under the interface between the steel and the slag in the operational mode shown in FIG. 1(*b*). Steel treatment alloys could also be introduced into the molten steel along the rotor axis by virtue of a passageway 6*a* opening through the bottom of the rotor 10 at the location 9. The slag treatment mixtures and some steel additives may be introduced to the surface of the slag 12 at the location 8.

It is to be understood that, in FIG. 1(*b*), the rotor 10 is being rotated at a speed sufficient to cause the vortex illustrated in FIG. 1(*b*) to be created. As can be seen, the interface 7 between the molten steel and the overlying slag extending inwardly and downwardly in a "bell-shape", and terminates at the upper face of the rotor 10. Located in the rotor are four passageways 12*a*, each of which has an upstream end opening through the upper surface of the rotor 10 adjacent the stem 10*a* of the rotor 10, and a bottom or downstream end opening at the periphery of the lower face of the rotor 10.

By virtue of the rotation of the rotor 10, and also due to the fact that the layer of slag 12 extends down to communicate with the upstream ends of the passageways 12*a*, the slag is thrown centrifugally outwardly along the passageways 12*a* and enters the molten steel in the form of bubbles or globules 13*a* which, due to their smaller densities, immediately bubble upwardly through the steel to rejoin the main layer of slag 12. It will be understood that the slag can only be pumped so long as the slag layer extends down to the upstream ends of the passageways 12*a*. Moreover, in order for bubbles of slag to be pumped into the steel, the interface between the steel and the slag must meet the rotor 10 at a location between the upstream end and the downstream end of the passageways 12*a*.

Several possible arrangements of the process apparatus shown in FIG. 1 could be utilized:

1. The driving unit and rotor are vertically stationary and the ladle is lifted upwards towards them.
2. The ladle is stationary and the whole driving unit with the rotor moves towards it.
3. The ladle and driving unit are stationary and only the rotor moves vertically using more sophisticated gears.

The rotor could be submerged to any depth and theoretically pump the slag. However, if the depth is too small for a certain ladle and rotor size, the pumping would cease due to a dry rotor center. When the rotor is placed deeper, better conditions for chemical reactions are obtained but the rotor size and/or the rotor speed will have to be increased. This will create more rigidity problems and higher demand for a power input to turn the rotor.

The slag layer should cover the metal bath fully during pumping. If the slag layer is too thin, the pumping depth will have to be decreased.

FIGS. 2(a) and 2(b) show two different rotor sizes at two different depths within a process vessel. In FIG. 2(a), a small rotor 10*b* is located at a relatively shallow depth, while in FIG. 2(b) a larger-diameter rotor 10*c* is located further down in the process vessel 14. It has generally been found that a rotor intended to operate at a greater depth should be of a larger diameter in order to produce a satisfactory vortex and good slag pumping. It will be realized that, for a given process vessel size, the deeper the rotor, the more pronounced and "pulled down" the vortex, and therefore the larger the interface area that results.

Generally, the process of this invention as it particularly relates to the art of steelmaking can be optimized by balancing the rotor dimensions and the speed of rotation. The best technological and the worst mechanical conditions arise when the rotor operates at or near the ladle bottom. The proper operating depth would constitute a trade-off between the technical and mechanical (economcial) factors.

The rotational speed is solely determined by the vortex depth requirement. The conditions for the vortex formation are dependent on the rotor dimensions. An overall optimization of the process parameters is thus possible. The pumping starts when the dynamic pressure is greater than the static pressure. The optimal flow is obtained when the dynamic pressure is about double the static pressure. Thus, three possible situations may develop when a submerged rotor increases its speed:

1. In a low speed range the slag vortex does not reach the upper surface of the rotor and only metal is recycled through a rotor pumping hole.
2. Pumping of the slag is established when the rotor speed is sufficiently high that the slag vortex fully covers the inflow openings of the rotor.
3. If the rotor speed for a certain rotor depth is too high the upper central rotor part is not covered with slag and the pumping ceases.

A satisfactory rotor speed range as applied to the process of this invention used in the steelmaking art, is from 50 to 200 rpm.

Attention is now directed to FIG. 3. In FIG. 3(*a*) representing the apparatus prior to the initiation of the process, the rotor 10 is located above the ladle 14 containing the molten steel 13 and an overlayer of slag 12. The distance 19 between the upper surface of the slag level and the upper rim of the ladle 14 is at its maximum. In FIG. 3(*b*) the rotor 10 is submerged into the steel bath 13 to a predetermined depth 15, but is not being rotated. The upper surface of the slag rises by a distance 20, because of the volume displacement occasioned by the entry of the rotor 10 into the molten steel. In FIG. 3(*c*), the rotor is undergoing rotation, and the vortex has been created. The upper slag line on the inner surface of the ladle 14 is again raised by a distance 21 due to the vortex creation. In FIG. 3(*d*) a wave motion has developed creating upwards and downwards slag and metal motions which can periodically raise the upper slag line by a further distance 22, depending upon the amplitude of the oscillations. A safety distance 23 as marked on FIG. 3(*b*) is required in order to prevent overflow of slag and/or steel.

It will be understood that the distance 19 seen in FIG. 3(*a*) must be large enough to accommodate all of the requirements and increases shown in FIG. 3(*a*) through 3(*d*). Usually 5 to 10 percent of the total steel and slag depth will be sufficient to achieve a safe distance 19.

The process of this invention requires a rotor capable of accomplishing the necessary pumping and of setting up a vortical configuration capable of drawing the upper, less dense liquid down to the surface of the rotor. Naturally, when the process of this invention is applied to the art of steelmaking, the rotor must be of a material capable of withstanding the heat of the melt. Although the rotor could be made using a variety of refractory materials, it has been found the rotors made from high alumina castable or rammed material have given very satisfactory results. The castable high alumina refractory material is advantageous because any complicated shape can be easily fabricated. The rammed high alumina refractory material can also be used, although it requires a stronger mold and takes much longer to manufacture.

Possibly a combination of various refractory materials could be used to obtain longer rotor service life.

One satisfactory rotor shape is shown in FIGS. 4(*a*), (*b*) and (*c*), to which attention is now directed. The rotor 10 is seen to consist of a stem 25 and a disc portion 26. The disc portion 26 has four pumping passageways 27, the general disposition of each passageway 27 being outwardly and downwardly oblique so that the inlet or upstream end of each passageway 27 occurs close to the stem 25, and so that the outlet or downstream end 28 of each passageway 27 occurs at the outer periphery of the under face 29 of the disc 26. The rotor further comprises a steel structure 24 which extends coaxially upwardly out of the stem 25 as a steel rod, and is buried centrally into the stem 25. At the bottom, the steel rod has fastened to it a cross-shaped member which is buried internally of the disc 26. The steel structure 24, including the cross-shaped member at the bottom, is intended to aid in withstanding mechanical and heat stresses. It will be understood that an air cooling system for the rotor and/or a pneumatic or other feed system for alloying materials could be built in as part of the steel structure 24. It will also be clear that larger rotors may require a more complicated steel structure, as compared to smaller rotors.

If required, the steel structure could be covered by asbestos clothing in order to allow for thermal dilatation.

The stem 25 has preferably a cylindrical form with an outer diameter large enough to give sufficient heat shield to the supporting steel structure 24. The pumping efficiency of the rotor as a whole appears to be improved when the stem diameter is kept as small as possible. Naturally, the length of the stem 25 is a function of the required pumping depth.

While the disc 26 could have a number of different configurations, it is necessary for the rotor to have at least one and preferably several of the pumping passageways 27 extending outwardly from an upstream end to a downstream end. Although in the embodiments illustrated the passageways all extend outwardly and downwardly on an oblique is not an essential part of this invention. What is essential is that one end of each passageway be closer to the axis than the other end, in order that centrifugal pumping may take place. From a practical point of view, however, it has been found that an outwardly and downwardly oblique orientation is quite satisfactory.

The cross-sectional configuration of the pumping passageways 27 may be of various shapes, although it will be appreciated that from a technical point of view a circular section presents the least amount of problem. The section could also be rectangular or square, however. Moreover, the area and sectional configuration of each pumping passageway 27 could be either uniform throughout its length or could change along its length to allow for changes in liquid speed.

A second embodiment of a suitable rotor, particularly one having larger dimensions than that shown in FIG. 4, is shown in FIGS. 5(*a*), 5(*b*) and 5(*c*). The rotor 110 includes a disc 126 of which the upper and lower surfaces converge toward each other at the periphery, as shown at 30 in FIG. 5(*a*) In FIG. 5(*a*) an equivalent discal rotor of the same diameter is shown in broken lines, and it will be understood that the specific converging shape of the surfaces of the rotor shown in FIG. 5 represents a removal of refractory material. Because this material has been "removed," there results an important reduction in the weight of the rotor, the reduction being up to about one-half the weight of the disc, without affecting the rotor performance. If the weight is reduced, this also lowers the vibrational and other mechanical problems associated with a heavier rotor shape.

In FIG. 5(*a*), the discal portion of the rotor is seen to include an annular channel 31 in the upper surface, although this is not considered essential to the present invention. The provision of the channel, however, is believed to improve the rotor pumping efficiency to some extent, and of course a channel similar to the channel 31 could also be incorporated into the rotor shape shown in FIG. 4.

The pumping passageways in any configuration of rotor shape could be arranged in such a way that they are radially disposed with respect to the center axis of the rotor i.e., that they point outwardly from the rotor axis. However, it is considered that the pumping efficiency of a rotor is improved if the passageways are arranged in such a way that the angle 39 shown in FIG. 5(*b* ) is about half-way between the angles for optimum inflow and optimum outflow of slag calculated from hydrodynamic theory. The direction of the angle 39 is of course related to the turning direction 40. Another variation, although somewhat impractical in terms of construction, is to dispose the passageways in a spiral configuration, again calculated with the use of hydrodynamic theory.

Figure 10:
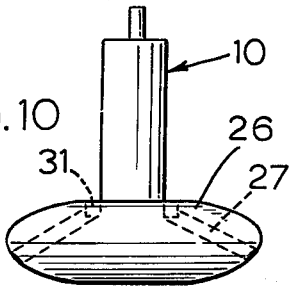
Figure 12:
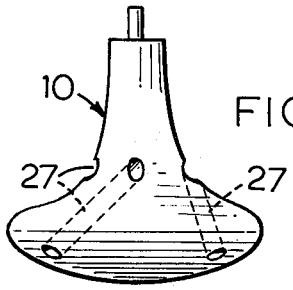
Figure 11:
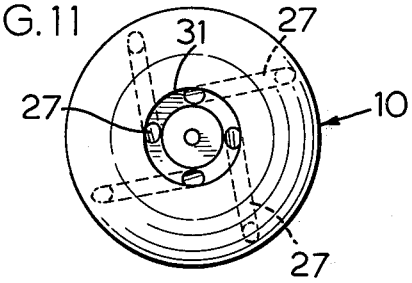
Figure 13:
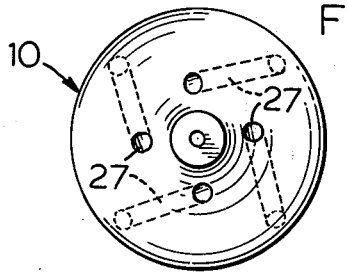

FIGS. 6 through 13 illustrate four basic variants, of rotor shape. These four shapes are merely examples of many shape combinations which might be developed. The rotor shape shown in FIGS. 6 and 7 requires the simplest manufacturing methods, but due to the sharp corners is prone to erosion. The second rotor shape shown in FIGS. 8 and 9 has been found to be the most suitable shape for small rotor dimensions (3 to 10 ton ladle). The rotor shape shown in FIGS. 10 and 11 has a number of functional advantages over the shapes shown in FIGS. 6 – 9, but when the rotor dimensions are too small with the configuration of FIGS. 10 and 11, the thickness of the refractory material directly above the passageways 27 is so small that there exists a real danger of erosion through to the passageways from the outer, upper surface. The shape shown in FIGS. 10 and 11 is considered satisfactory for 10 –50 ton ladles. For larger rotor dimensions, i.e., those suitable for ladle sizes above 50 tons, the rotor shape shown in FIGS. 12 and 13 is considered preferable.

Before turning to the examples, it is appropriate to turn back briefly to the chemistry of the process of this invention as it applies to the steelmaking art. It will be recalled that one objective of utilizing the process of this invention in a steelmaking ladle is to reduce the sulphur content in the molten steel by causing the interface between the steel and the slag to be increased through pumping and vortex creation so that the sulphur is, in effect, transferred from the molten steel to the slag. With a given slag volume and a particular initial sulphur content in the molten steel, a given pumping time will result in a certain final sulphur content in the molten steel. Generally, however, this final sulphur content in the molten steel can be reduced to some extent (for the same pumping time) by increasing the slag volume, since the slag body as a whole will then have a greater "capacity" for receiving sulphur from the steel.

EXAMPLE I

In a steel refining installation 5000 lb. of steel and 170 lb. of slag is melted. The sulphur content of steel and slag is 0.050 and 0.053 percent respectively The rotor is lowered to the predetermined depth into the steel bath, while rotating slowly (50 rev./min.). The steel temperature is about 2900°F. The rotor speed is increased to about 175 rev./min. (vessel – 28 in. dia.; rotor – 18 in. dia.). The slag pumping starts at 150 rev./min. As soon as the slag is melted by the pumping action, a slag treatment mixture consisting of 40 lb. of lime, 10 lb. of spar, 5 lb. of carbocoke and 10 lb. of fine ferrosilicium is continuously fed with a rate of 10 lb./min. Two samples of the steel and the slag are taken while the pumping is interperted for a short time interval. After about 7 minutes of pumping the rotor is slowed down and removed from the steel bath.

The slag weight is now at about 220 lb. or 90 lb./ton of steel. The sulfur content in the steel is reduced from 0.050 to 0.013 percent. The sulphur partition ratio (i.e., the ratio between the sulphur content in the slag and the sulphur content in the steel) is about 60 at the end of the steel refining process.

EXAMPLE II

The steel weight in the same vessel is again 5000 lb. The slag weight is slightly lower at about 150 lb. The sulphur content in the steel is about three times lower at 0.017 percent.

The pumping starts at about 2850°F. After initial rotor positioning and slag melting by the rotor pumping action, a slag treatment mixture consisting of 30 lb. of lime 5 lb. of spar and 15 lb. of fine ferrosilicium is continuously fed. After about 5 minutes the feeding and the pumping is terminated. The rotor speed, when pumping, is held at 200 rev./min. because of smaller rotor size (15 in. dia.).

The sulphur in the steel is reduced from 0.017 to 0.005 percent during the process application. The slag weight at the end of the treatment is 80 lb./ton of steel.

EXAMPLE III

The weights of the steel and the slag, as well as the sulphur content in the steel, are similar to that in Example II. The slag treatment mixture composition and the feeding practice are also comparable to that described in Example II. The reduction of sulphur in the steel from an initial 0.020 percent to 0.004 percent at the end of the process application is also about the same as in Example II.

The difference is in the addition of metallic mishmetal (53 percent cerium content) after the slag treatment procedure but about one minute before the end of slag pumping.

The recovery of cerium is 78 percent, a much higher figure than in other known practices.

I claim:

1. A method of increasing the surface contact between two immiscible liquids of different specific densities, comprising the steps:

placing the two liquids in a container to form an interface with the less dense liquid above the interface and the more dense liquid below the interface, providing a rotor of substantially circular outline having generally an upper face and a lower face, the rotor having a diameter of at least about one-third of the container internal diameter, the rotor having at least one internal passageway which opens at one end through the upper face at a first location adjacent the rotor axis, the other end of the passageway opening at a second location on the rotor axis that is said first location, inserting said rotor into said container sufficiently far to bring said upper face beneath said interface when the liquids are at rest, the axis of the rotor being generally vertical, and rotating the rotor about its axis at a speed sufficient to draw a part of the interface down to the upper face of the rotor, whereby the less dense liquid passes into said one end of said passageway and is pumped through said passageway into said more dense liquid.

2. The method claimed in claim 1, in which the other end of the passageway opens substantially at the periphery of said lower face, and in which the passageway is substantially rectilinear.

3. The method claimed in claim 2, in which the rotor is of substantially cylindrical configuration, and has a plurality of rectilinear passageways offset from a radial orientation.

4. The method claimed in claim 3, in which there are four passageways spaced 90° from each other around the rotor, and in which the rotor has on its upper face an annular coaxial channel within which each passageway opens.

5. The method claimed in claim 4, in which the rotor includes an axial feed passage through which additional material may be fed into the container when the rotor is rotating, the method including the additional step of passing further material into the container when the rotor is rotating.

6. The method claimed in claim 1, in which the diameter of the rotor is about two-thirds of the inside diameter of the container.

* * * * *